US010116106B2

(12) United States Patent
Byrne et al.

(10) Patent No.: US 10,116,106 B2
(45) Date of Patent: Oct. 30, 2018

(54) CUSHION-MOUNTED ELECTRICAL OUTLETS

(71) Applicants: Norman R. Byrne, Ada, MI (US); Joseph D. Ward, Grand Rapids, MI (US)

(72) Inventors: Norman R. Byrne, Ada, MI (US); Joseph D. Ward, Grand Rapids, MI (US)

( * ) Notice: Subject to any disclaimer, the term of this patent is extended or adjusted under 35 U.S.C. 154(b) by 0 days.

(21) Appl. No.: 15/835,570

(22) Filed: Dec. 8, 2017

(65) Prior Publication Data

US 2018/0166835 A1 Jun. 14, 2018

Related U.S. Application Data

(60) Provisional application No. 62/432,342, filed on Dec. 9, 2016.

(51) Int. Cl.

| | |
|---|---|
| ***H01R 11/00*** | (2006.01) |
| ***H01R 13/73*** | (2006.01) |
| ***A47C 7/72*** | (2006.01) |
| ***H01R 13/516*** | (2006.01) |
| ***H01R 27/02*** | (2006.01) |

(52) U.S. Cl.

CPC ..... *H01R 13/73* (2013.01); *A47C 7/72* (2013.01); *H01R 13/516* (2013.01); *H01R 27/02* (2013.01)

(58) Field of Classification Search

CPC ..... H01R 31/06; H01R 31/08; H01R 25/162
USPC ..... 439/502, 511, 215
See application file for complete search history.

(56) References Cited

U.S. PATENT DOCUMENTS

| | | | | |
|---|---|---|---|---|
| 3,373,921 | A | 3/1968 | Lin | |
| 5,351,173 | A * | 9/1994 | Byrne | A47B 21/06 362/127 |
| 6,089,892 | A * | 7/2000 | Snow | H02G 3/00 174/505 |
| 6,486,407 | B1 | 11/2002 | Hawker et al. | |
| 6,540,554 | B2 | 4/2003 | McCarthy | |
| 7,083,421 | B1 | 8/2006 | Mori | |
| D568,817 | S | 5/2008 | Yu | |
| 7,442,090 | B2 | 10/2008 | Mori et al. | |
| 7,488,203 | B2 | 2/2009 | Leddusire | |
| 7,557,297 | B2 | 7/2009 | Axland et al. | |
| 7,625,241 | B2 | 12/2009 | Axland et al. | |
| 7,625,242 | B2 | 12/2009 | Axland et al. | |

(Continued)

OTHER PUBLICATIONS

Couchlet: Power Up Your Sofa, Indiegogo, downloaded from www.indiego.com/projects/couchlet-power-up-your-sofa-usb#/, Oct. 11, 2016.

(Continued)

*Primary Examiner* — Phuong Chi T Nguyen
(74) *Attorney, Agent, or Firm* — Gardner, Linn, Burkhart & Ondersma LLP

(57) ABSTRACT

A cushion-mountable electrical outlet system for furniture includes a generally flat body having a lower portion that is positionable beneath a cushion of a furniture article. The flat body has an upper portion configured to be positioned along a side edge of the cushion, and an electrical outlet assembly mounted at the upper portion of the flat body. The electrical outlet assembly is positionable so as to be accessible to a user on the cushion. The flat body is plastically deformable so that the lower portion can be angled obliquely relative to the upper portion.

20 Claims, 6 Drawing Sheets

(56) References Cited

U.S. PATENT DOCUMENTS

| | | | | |
|---|---|---|---|---|
| 7,626,119 | B2 | 12/2009 | Axland et al. | |
| 7,645,169 | B2 | 1/2010 | Axland et al. | |
| 7,731,540 | B2 | 6/2010 | Mori et al. | |
| D626,071 | S | 10/2010 | Su et al. | |
| D628,157 | S | 11/2010 | Su et al. | |
| 7,938,679 | B2 | 5/2011 | Wadsworth et al. | |
| D642,529 | S | 8/2011 | Su et al. | |
| 3,058,839 | A1 | 11/2011 | Saw | |
| 8,292,657 | B2 | 10/2012 | Singh | |
| 8,295,036 | B2 * | 10/2012 | Byrne | H01R 25/003 174/57 |
| 8,330,041 | B2 | 12/2012 | Axland et al. | |
| D682,789 | S | 5/2013 | Au | |
| D691,953 | S | 10/2013 | Chayer | |
| 8,920,191 | B2 | 12/2014 | Carpanzano | |
| 8,951,054 | B2 * | 2/2015 | Byrne | H01R 35/04 307/104 |
| 9,257,803 | B2 | 2/2016 | Alagna et al. | |
| 2004/0261175 | A1 | 12/2004 | May | |
| 2005/0106933 | A1 | 5/2005 | Yap | |
| 2007/0087604 | A1 * | 4/2007 | Hayes | H01R 25/16 439/215 |
| 2011/0215759 | A1 | 9/2011 | Lee et al. | |
| 2013/0291304 | A1 | 11/2013 | Steinberg | |
| 2013/0333940 | A1 | 12/2013 | Stencil | |
| 2016/0226279 | A1 | 8/2016 | Anderson | |
| 2016/0242564 | A1 | 8/2016 | Cass | |

OTHER PUBLICATIONS

Nuplug™ the most convenient outlet for your smart-devices, Shopstarter, downloaded from www.shopstarter.com/p/1704062015/nuplugtm-the-most-convenie, Oct. 11, 2016.

Studio 3B™ 4-Piece USB Bed Lift Set, Bed Bath & Beyond, downloaded from www.bedbathandbeyond.com/store/product/studio-3b-4-piece-usb, Oct. 11, 2016.

* cited by examiner

CUSHION-MOUNTED ELECTRICAL OUTLETS

CROSS REFERENCE TO RELATED APPLICATION

The present application claims the benefit of U.S. provisional application Ser. No. 62/432,342, filed Dec. 9, 2016, which is hereby incorporated herein by reference in its entirety.

FIELD OF THE INVENTION

The present invention relates to electrical power systems and, more particularly, to electrical power systems supported along furniture.

BACKGROUND OF THE INVENTION

The need or desire to incorporate electrical power outlets in different locations has increased as portable electronic devices such as mobile phones, portable media players, and the like have proliferated, since these devices often require frequent charging of onboard batteries. Such devices typically require access to either low voltage (e.g., 2V DC to 12V DC) power outlets, or high voltage (e.g., 110V AC or 220V AC) power outlets together with a DC power converter.

SUMMARY OF THE INVENTION

The present invention provides an electrical outlet assembly with high voltage AC (e.g. 110V or 220V) and/or low voltage DC (e.g., 2V DC to 12V DC) electrical outlets positioned at a convenient location alongside a support cushion, such as a seating cushion of a chair, a bed mattress, or the like. The electrical outlet assembly is held in place by gravity and friction, typically without the use of any fasteners, and thus is readily removed, replaced, and relocated to other furniture articles as desired by a user. Optionally, a portion of the electrical outlet assembly is formable or reconfigurable to accommodate different thicknesses of cushion, or to adjust the height at which the electrical outlets are positioned relative to a top surface of the cushion.

According to one form of the present invention, a cushion-mountable electrical outlet system for furniture includes a generally flat body, an electrical outlet assembly mounted to the flat body, at least one electrical outlet, and an electrical cord. The flat body has a proximal end portion configured to be positioned between a cushion and a panel of a furniture article that is proximate the cushion. The flat body has an upright distal end portion configured to be positioned alongside an upright side edge of the cushion, and a deformable region below the upright distal end portion. The electrical outlet assembly is mounted at the distal end portion of the flat body and positionable so as to be accessible to a user supported at the cushion. The electrical outlet is mounted in the electrical outlet assembly and faces generally upwardly, while the electrical cord is in electrical communication with the electrical outlet and exits the electrical outlet assembly for coupling to a power source such as a wall or floor outlet.

In one aspect, the generally flat body is at least partly made up of a resinous material disposed around a plastically deformable metal in the deformable region.

In another aspect, the generally flat body includes a pair of parallel spaced-apart legs that are joined at their respective proximal ends by a bight portion opposite the electrical outlet assembly. Optionally, each of the legs includes a resinous material disposed around a plastically deformable metal in the deformable region.

In yet another aspect, the electrical cord exits a lower region of the electrical outlet assembly and is spaced between the legs as it exits the outlet assembly.

In a further aspect, the generally flat body is plastically deformable at different locations along a continuum of the deformable region.

In still another aspect, the electrical outlet assembly is positionable at different angles relative to the upright distal end portion of the flat body.

In a still further aspect, the flat body defines a passageway extending from the proximal end portion to the distal end portion through which the electrical cord is routed, and the electrical cord extends the entire length of the flat body. Optionally, the passageway of the flat body is located along a central longitudinal axis thereof.

In another aspect, the electrical outlet assembly includes one or more of a high voltage AC power outlet, a low voltage DC power outlet, and an electronic data outlet.

In yet another aspect, the electrical outlet assembly has a substantially planar top surface with one or more openings corresponding to power outlet(s). The top surface is non-perpendicular to the upright distal end portion of the flat body, and the top surface is angled relative to a horizontal plane when the upright distal end portion of the flat body is oriented in a vertical plane.

According to another form of the present invention, a cushion-mountable electrical outlet system for furniture includes a generally flat body, an electrical outlet assembly coupled to the flat body, and an electrical receptacle mounted at the electrical outlet assembly. The flat body has an upper end portion, a plastically deformable region, and a lower end portion. The deformable region can be deformed to set the lower end portion at an oblique angle relative to the upper end portion. The lower end portion is intended be positioned between a downwardly-facing surface of a cushion and an upwardly-facing surface of a furniture article that supports the cushion. The upper end portion is intended to be positioned alongside an upright side edge of the cushion. The electrical outlet assembly is coupled to the upper end portion of the flat body and is positionable so as to be accessible to a user supported at the cushion. The electrical outlet assembly includes a downwardly-facing lower surface for engaging an upwardly-facing top surface of the cushion. The electrical receptacle at the electrical outlet assembly is positioned above the downwardly-facing lower surface.

Therefore, the present invention provides an electrical outlet assembly that can be readily positioned and re-positioned at convenient locations alongside a support cushion, such as in a seating or sleeping area or the like. The electrical outlet assembly is held in place by gravity and friction, and a portion of the electrical outlet assembly may be bendable and re-bendable to accommodate different thicknesses of cushion, or to adjust the height at which the electrical outlets are positioned for use.

These and other objects, advantages, purposes and features of the present invention will become apparent upon review of the following specification in conjunction with the drawings.

DESCRIPTION OF THE PREFERRED EMBODIMENTS

Figure 1A:
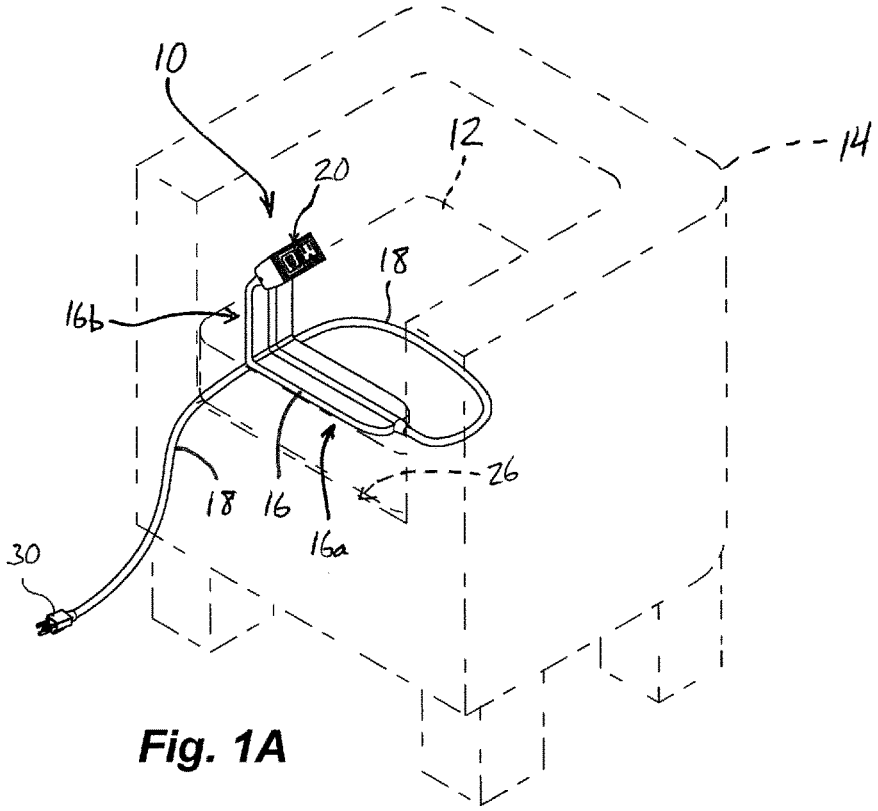
FIG. 1A is a first perspective view of a cushion-mountable electrical outlet in accordance with the present invention, shown supported at a chair depicted in phantom.
Figure 1B:
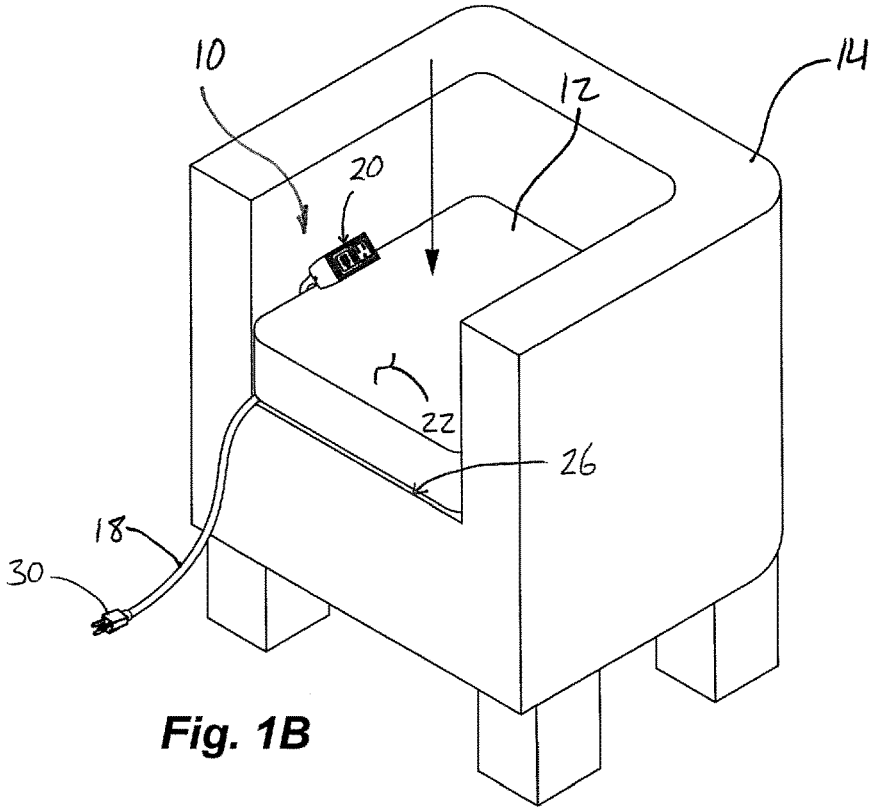
FIG. 1B is a second perspective view of the cushion-mountable electrical outlet and chair of FIG. 1A, in which the chair is depicted in solid lines and an arrow indicates cushion placement.

Referring now to the drawings and the illustrative embodiments depicted therein, a cushion-mountable electrical outlet assembly 10 is specially adapted for installation at or along a cushion 12 of a chair 14 or other seating (FIG. 1). Outlet assembly 10 may also be installed at or along a bed mattress or substantially any other locations where it is desirable to provide users with convenient access to electrical power and/or electronic data receptacles, and where one surface lies in close proximity to or is pressed against another surface. Outlet assembly 10 includes a relatively wide and flat body 16 having a lower or proximal end portion 16*a* where a length of cord 18 exits, and an upper or distal end portion 16*b* where an electrical outlet assembly 20 is mounted. As will be described in greater detail below, flat body 16 is formable such as by manual bending, so that lower body portion 16*a* is positioned directly underneath cushion 12, and upper body portion 16*b* is positioned alongside cushion 12 and may optionally extend at least a short distance above an upper surface 22 of cushion 12 so that electrical outlets 24 (FIG. 2) of the electrical outlet assembly 20 are readily accessible to a user seated at or near the cushion 12.

Flat body 16 has a sufficient width W (FIG. 2) so that it will resist rotating about a longitudinal axis Al of lower body portion 16*a* when positioned between cushion 12 and a cushion support 26 (FIGS. 1A and 1B) of chair 14. Although flat body 16 may be formed to substantially any desired length, it is envisioned that overall lengths ranging from about 12 to 16 inches will be sufficient for most applications. Flat body 16 may be formed from a sheet of material that is initially planar, or substantially planar, such as by bending in a manner shown in FIGS. 4 and 5. Depending on the rigidity of flat body 16, the body may be formed to its final shape during a manufacturing operation, such as using a bending die, or may be sufficiently non-rigid and flexible so as to permit manual bending in the hands of an end user. In the case of a less rigid flat body 16, it is envisioned that an end user may un-bend and re-bend the flat body 16 as desired. Optionally, the flat body 16 may be plastically deformable at different locations along a continuum of its length, or along at least a deformable region of its length.

Flat body 16 may be formed of aluminum in an extrusion process, for example, or may be formed (such as by molding or extrusion) from a less rigid resinous material such as SANTOPRENE® brand thermoplastic elastomer ("TPE"), which is available from Exxon Mobil Corp. of Irving, Tex. TPE and other resinous materials such as soft rubber or rubber-like materials may also exhibit higher friction coefficients with fabrics, leather, vinyl, and other materials typically used for furniture, as compared to aluminum and other metals, as well as compared to harder plastic materials. Higher friction coefficients may be desirable to increase the flat body's resistance to inadvertent movement between cushion 12 and upper surface 22 of chair 14. Friction coefficients may further be increased by molding or otherwise forming a rough or knobby surface texture into the outer surfaces of flat body 16, and it will further be appreciated that a coarse grit-like surface (similar to coarse sandpaper) may be provided along flat body 16 in order to resist undesirable sliding or shifting of the electrical outlet assembly 10 as persons sit or shift their weight along cushion 12.

A central channel region 28 extends along flat body 16 and contains cord 18. Where flat body 16 is formed of extruded aluminum or similar, central channel region 28 may be a generally cylindrical hollow tube formed by the extrusion mold, with the cord 18 being routed through the channel region 28 after the flat body 16 is cut to length, and before flat body 16 is formed to its final shape. In such an arrangement, a rubber grommet or the like may be fitted to one or both ends of central channel region 28, surrounding cord 18, to provide a strain relief. Where flat body 16 is instead formed of molded thermoplastic material, it may be overmolded directly around a portion of cord 18, thus avoiding a separate cord-insertion step and providing a cord strain relief to resist pull-out of the cord from electrical outlet assembly 20.

Cord 18 is a flexible member formed from two or more individually insulated electrical conductors that may be jacketed by TPE or other flexible material, and a conventional plug 30 may be fitted at a proximal end 18*a* of cord 18, such as shown in FIGS. 1A-3. In the illustrated embodiment, plug 30 is a standard 3-prong NEMA connector for U.S. 110VAC applications, but it will be appreciated that substantially any electrical power and/or electronic data connector may be used for a desired application, without departing from the spirit and scope of the present invention. Cord 18 may be substantially any desired length that is sufficient to extend out from under the cushion 12 and extend away from the furniture article 14 to reach an electrical power source or electronic data connections, such as at a wall or floor outlet in a room. For example, a cord length extending outwardly from flat body 16 by about 6 to 12 feet may be sufficient for most applications. In the illustrated embodiment of FIGS. 1A and 1B, cord 18 is routed out of the chair 14 through a front region between cushion 12 and cushion support 26, but it will be appreciated that other routing options may be available depending on furniture configuration, such as through a bottom or rear of the furniture, which may improve aesthetics by hiding or at least partially obscuring the power cord from view.

Where flat body 16 is formed of molded thermoplastic material, one or more bendable or pliable wires that are easily plastically deformed and tend to maintain new shapes to which they are bent, are overmolded by the material of flat body 16 and serve to maintain flat body 16 in a desired shape, since the thermoplastic material of flat body 16 may otherwise tend to return to its original molded shape. Such wire is generally known as "armature wire" and may be made from steel, aluminum, or the like, and is preferably a material that resists work-hardening so that it may be reformed many times without breaking.

Electrical outlet assembly 20 is attached to upper end portion 16*b* of flat body 16, and receives a distal end portion of power cord 18 through central channel region 28. Optionally, upper end portion 16*b* terminates at an outwardly-flared or expanded-thickness end 32 where outlet assembly 20 is mounted. Outlet assembly 20 may be attached to flat body 16 using various known methods including threaded fasteners, twist-lock fasteners, snap-fit or latching elements, slide-in bracket-and-slot connections, and the like. Various connecting methods and structures that may be used for attaching outlet assembly 20 to flat body 16 are disclosed, for example, in commonly-owned U.S. Pat. Nos. 6,379,182; 7,736,178; and 9,148,006, which are all hereby incorporated herein by reference in their entireties.

In the illustrated embodiments, electrical outlet assembly 20 includes an extruded generally C-shaped housing 34 having an end cap 36 mounted at each end thereof, and with an open front region in which one or more electrical power outlet receptacles 24 and/or electronic data outlets are mounted, such as in a manner more fully described in commonly-owned U.S. Pat. Nos. 7,736,178; 8,444,432; 8,480,429; and 9,312,673, which are all hereby incorporated herein by reference in their entireties. Electrical outlet assembly 20 may be sized and shaped to support one or more electrical outlets 24, including high voltage AC outlets 24*a*, low voltage DC outlets 24*b* (such as USB-style outlets), and/or electronic data outlets such as connectors or receptacles for audio, video, telephone, Ethernet, HDMI, fiber optic, and the like. It will be appreciated that low voltage DC outlets 24*b* may be supplied with low voltage DC current by an electrical converter mounted in housing 34, the electrical converter receiving AC line voltage from the conductors of power cord 18 and converting to a low voltage DC output that is supplied to one or more low voltage DC outlets 24*b*, such as more fully described in commonly-owned U.S. Pat. No. 9,312,673, which is hereby incorporated herein by reference in its entirety. However, it is further envisioned that power cord 18 may be adapted to carried low voltage power and/or electronic data signals, instead of or in addition to high voltage AC electrical current, depending on the application and the availability of separate low voltage DC power and/or electronic data connectors to which electrical outlet assembly 10 may be connected.

In the illustrated embodiment of FIGS. 1A-2 and 4-6B, cushion-mountable electrical outlet assembly 10 includes one high voltage AC receptacle 24*a* and one low voltage USB-style double-outlet DC power receptacle 24*b* mounted in housing 34, with a single three-conductor (line, neutral, ground) AC power cord 18 and plug 30 supplying power to both receptacles 24. Thus, it is envisioned that an AC-to-DC power converter would be contained in housing 24 to supply low voltage DC power to DC power receptacle 24*b* as described above. C-shaped housing 34 is cut to length in order to accommodate the two receptacles 24, and the width W of flat body 16 generally corresponds to the length of housing 34.

Figure 3:
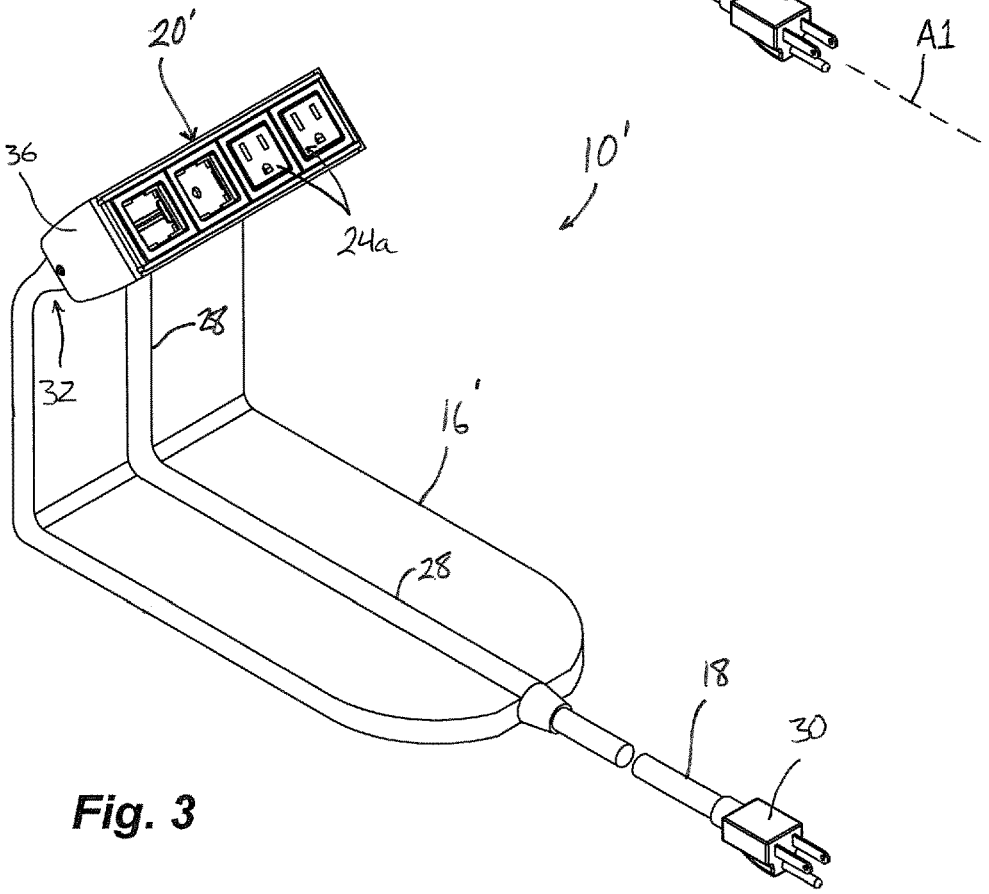
FIG. 3 is a perspective view of an extra-width cushion-mountable electrical outlet in accordance with the present invention.

However, in other embodiments the length of the electrical outlet assembly's housing and the width of flat body may be adjusted according to the number of outlets or outlet openings desired. For example, and with reference to FIG. 3, another cushion-mountable electrical outlet assembly 10' has an electrical outlet assembly 20' and a flat body 16' dimensioned for four outlet receptacles 24. In the embodiment of FIG. 3, electrical outlet assembly 20' supports two AC outlets 24*a* and two blank "windows" 24*c* that could be fitted with AC outlets, DC outlets, or substantially any electronic data outlets, or which can be left open as shown. In order to accommodate various different styles of outlets, windows 24*c* may be fitted with adapters, such as more fully described in U.S. Pat. Nos. 7,182,633; 7,559,795; 8,444,432; and 8,480,429, which are all hereby incorporated herein by reference in their entireties. In other respects, the wider cushion-mountable electrical outlet assembly 10' is substantially the same as the narrower cushion-mountable electrical outlet assembly 10, such that its features and operation may be readily understood with reference to the descriptions contained herein.

Figure 6A:
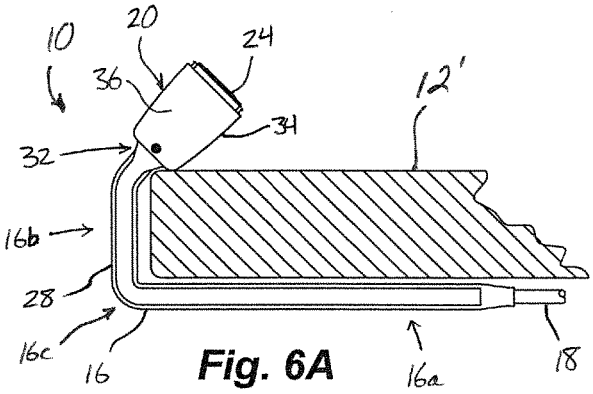
FIGS. 6A and 6B are right side elevations of the cushion-mountable electrical outlet formed for use with a relatively thinner cushion and a relatively thicker cushion, respectively.
Figure 6B:
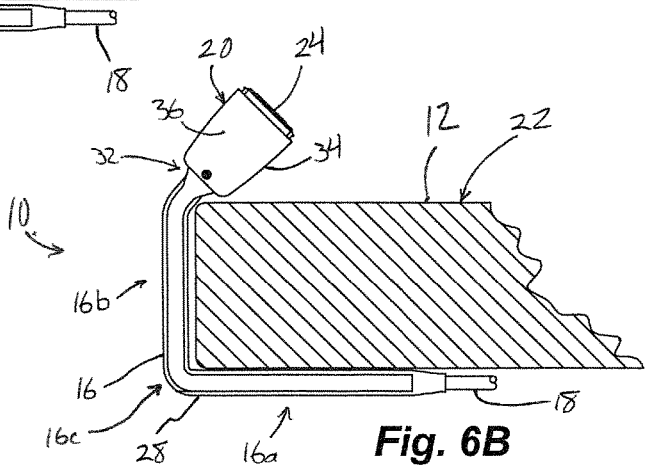

As noted above, the flat body 16 of cushion-mountable electrical outlet assembly 10 may be formed to a desired shape during production, such as to fit a relatively thicker cushion 12 (FIGS. 1A, 1B, and 6B), or to fit a relatively thinner cushion 12' such as shown in FIG. 6A. The same overall length of flat body 16 may be used, with a bend region 16*c* formed at a desired location along the length of flat body 16 to increase or decrease the height of upper end portion 16*b* and to correspondingly decrease or increase the length of lower end portion 16*a*. In FIG. 6A there is shown a flat body 16 with bend region 16*c* formed closer to electrical outlet assembly 20, thus providing a shorter upright upper end portion 16*b* and a longer horizontal lower portion 16*a* of the flat body, so that a lower region of electrical outlet assembly 20 is adjacent an upper surface 22' of the thinner cushion 12'. In FIG. 6B there is shown a flat body 16 with its bend region 16*c* formed further from electrical outlet assembly 20, thus providing a longer upright upper end portion 16*b* and a shorter horizontal lower portion 16*a* of the flat body, so that the lower region of electrical outlet assembly 20 is adjacent upper surface 22 of the thicker cushion 12. It is also envisioned that flat body 16 may be made from a sufficiently flexible and formable material, as described above, so that the flat body may be bent, straightened, and re-bent by an end user to fit different thicknesses of cushions (or mattresses or the like), or to set a desired height and/or angle of the outlets 24 relative to the cushions.

Figure 2:
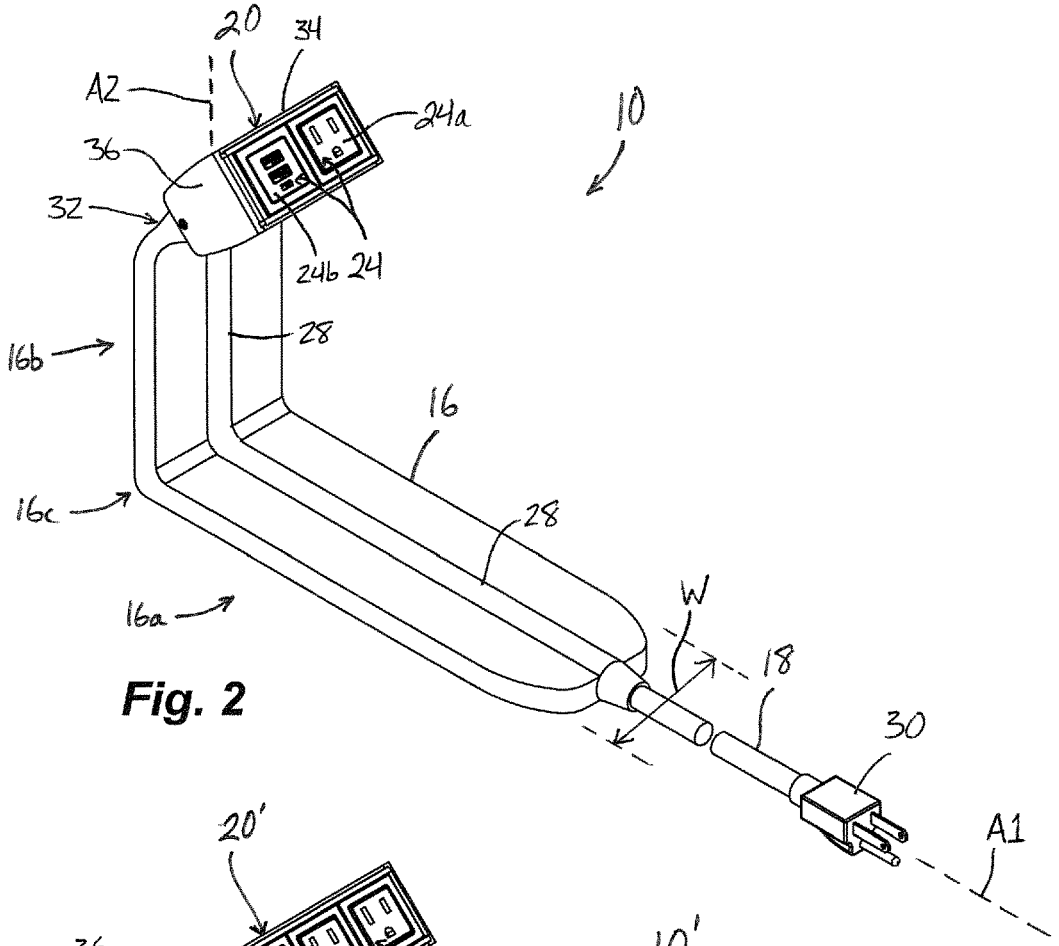
FIG. 2 is an enlarged perspective view of the cushion-mountable electrical outlet of FIG. 1A.

As shown in FIG. 2, the flat body's lower portion 16*a* and upper portion 16*b* may be formed as substantially planar sections, with the upper portion 16*b* having its own longitudinal axis A2 that is substantially perpendicular to the longitudinal axis A1 of lower portion 16*a*, and a 90-degree angle formed at bend region 16*c*. However, the angle formed at bend region 16*c* may be greater or less than 90-degrees, and also the angle at which electrical outlet assembly 24 is set relative to upper portion 16*b* may be adjusted as desired to set the direction faced by electrical outlets 24. It is further envisioned that either or both body portions 16*a*, 16*b* may be at least somewhat arcuate in shape, possibly incorporating compound curves, in order to accommodate different shapes of furniture structure and cushions. Thus, in some applications there may not be a distinct bend region that is clearly defined between upper and lower portions of the flat body, and instead there may be a more gradual curve or transition from lower portion to upper portion.

Figure 7:
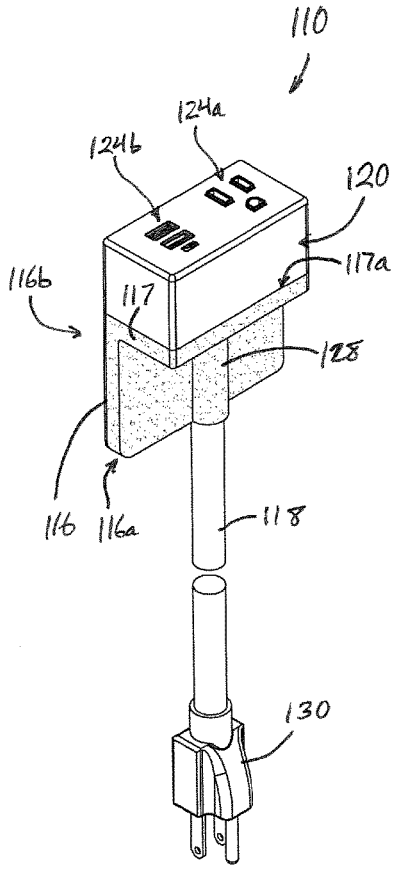
FIG. 7 is a perspective view of another cushion-mountable electrical outlet in accordance with the present invention.
Figure 8:
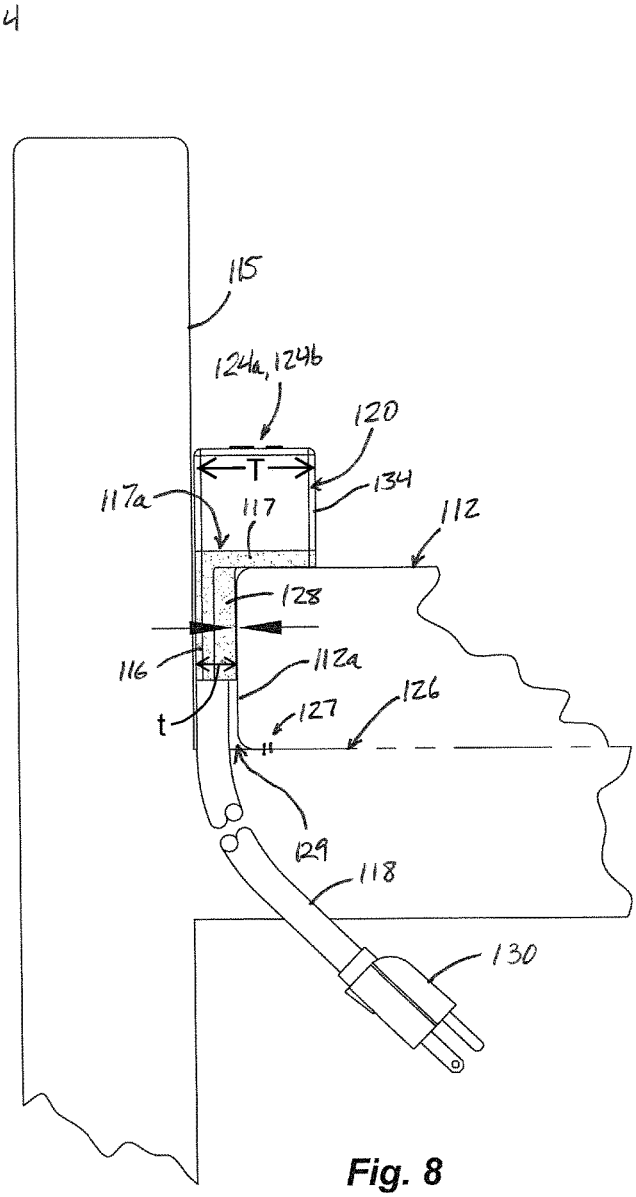
FIG. 8 is a right side elevation of the cushion-mountable electrical outlet of FIG. 7, shown supported between an arm and a cushion of a furniture article.

Optionally, and with reference to FIGS. 7 and 8, a cushion-mountable electrical outlet assembly 110 is adapted for installation along a soft seating surface 112 of a furniture article 114 in which the soft seating surface 112 is either attached directly to an underlying cushion support 126, such as shown in FIG. 8, or is upholstered so as to appear to be a one-piece cushion with a cushion support that is hidden from view. In the illustrated embodiment of FIG. 8, little or no access is provided to the area between the soft seating surface 112 (which is essentially a built-in cushion) and cushion support 126. For example, soft seating surface 112 may be an upholstered cushion that is sewn directly to an upper surface of cushion support 126 with stitching 127, as shown. However, furniture article 114 also has an upright arm portion 115 located just outboard of an outboard end 112*a* of soft seating surface 112, and which may normally contact outboard end 112*a* but is not attached thereto, thus providing a space 129 in which a generally flat body 116 of electrical outlet assembly 110 can extend and be frictionally engaged by pressure (indicated by opposing arrows in FIG. 8) exerted by soft seating surface 112 in the direction of upright arm portion 115.

Flat body 116 has a lower proximal end portion 116*a* and an upper distal end portion 116*b* where there is an angled body portion 117 that has a longitudinal axis that is angled at about 90 degrees relative to the longitudinal axis of flat body 116, although it will be appreciated that other angles are envisioned such as about 45 degrees (from parallel) to about 135 degrees (i.e. forming an acute angle with flat body 116). Angled body portion 117 and flat body 116 may be unitarily formed, such as in a molding operation. An electrical outlet assembly 120 is coupled to an outer or upper face 117*a* of angled body portion 117, and in the illustrated embodiment, includes both a high voltage AC outlet 124*a* and a low voltage DC outlet 124*b*. Electrical outlet assembly 120 may be coupled to angled body portion 117 using substantially any suitable means such as threaded fasteners or rivets, adhesives, ultrasonic welding, and the like. Optionally, an outer housing 134 of electrical outlet assembly 120 may be unitarily formed with angled body portion 117 and/or with flat body 116, although it may be desirable to form outer housing 134 of a harder material as compared to angled body portion 117 and especially flat body 116, which is held in place between soft seating surface 112 and upright arm portion 115 by friction and gravity.

Flat body 116 defines a wiring passageway 128 extending from proximal end portion 116*a* to distal end portion 116*b* along the longitudinal axis of flat body 116. An electrical cord 118 is routed through wiring passageway 128, which continues through angled body portion 117 and into a lower region of electrical outlet assembly 120 where the wiring is electrically connected to the electrical terminals of the outlets 124*a*, 124*b*, albeit via a power transformer in the case of low voltage DC outlet 124*b*.

Cushion-mountable electrical outlet assembly 110 relies upon highly frictional engagement between outer surfaces of flat body 116 and the outboard end 112*a* of soft seating surface 112 and an inwardly-facing surface 115*a* of upright arm portion 115 of furniture article 114. Therefore, the same relatively soft materials with high friction coefficients, and/or rough surface texture as described above, or even surfaces like the hook-side of a hook-and-loop fastener arrangement, may be used along flat body 116 to help resist the assembly 110 inadvertently moving relative to the furniture article. Flat body 116 may be more rigid than the longer flat body 16 described above, particularly since flat body 116 is not adapted to curve underneath a cushion or the like.

Figure 9:
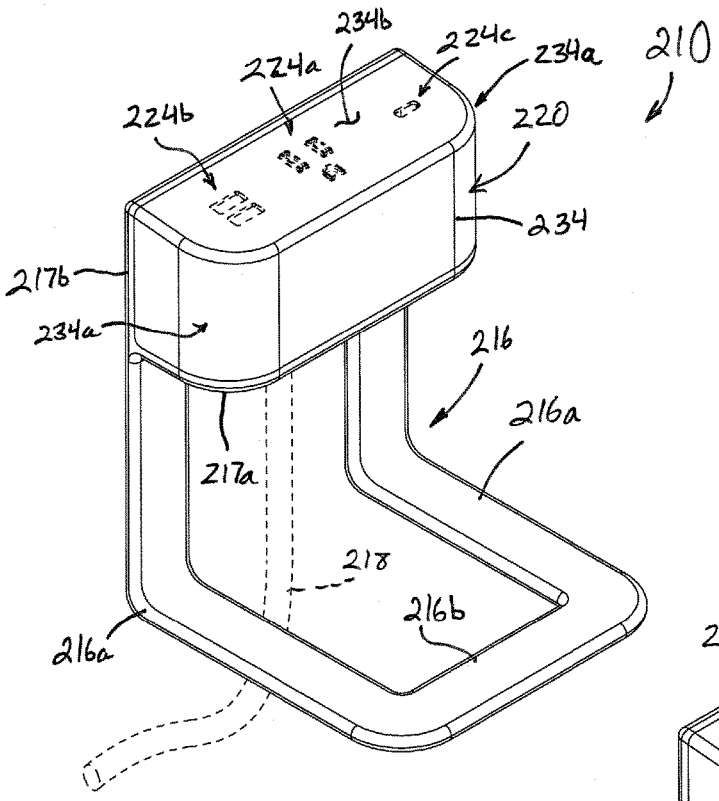
FIG. 9 is a perspective view of another cushion-mountable electrical outlet in accordance with the present invention, shown in a bent configuration.
Figure 10:
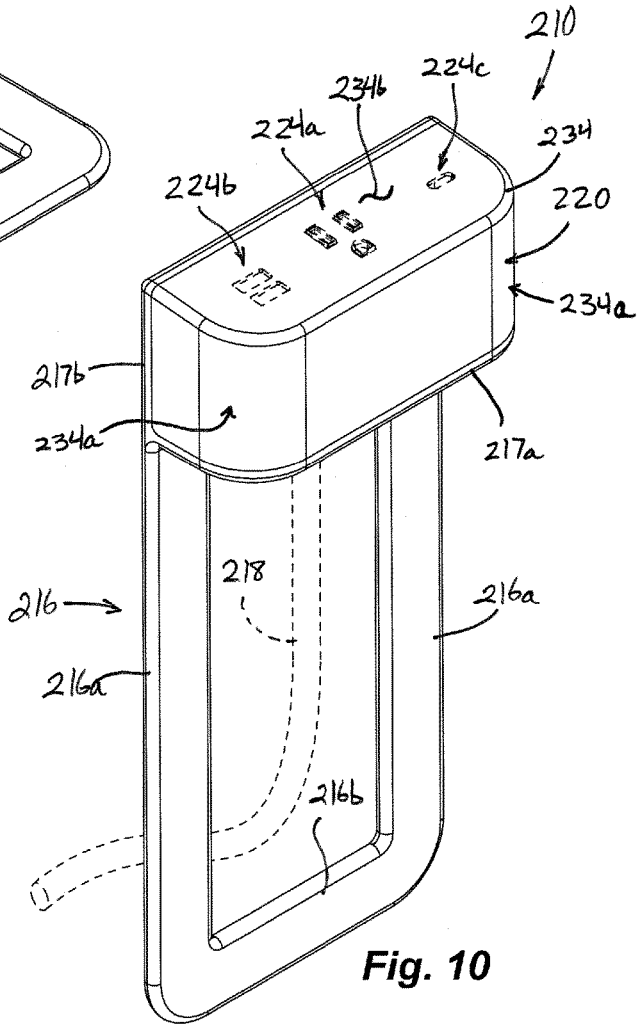
FIG. 10 is another perspective view of the cushion-mountable electrical outlet of FIG. 9, shown in a straight configuration.

Various other arrangements of cushion-mountable electrical outlet assemblies are envisioned, such as a cushion-mountable electrical outlet assembly 210 having a flat body 216 formed as a generally rectangular loop of material at its lower region, and a generally L-shaped upper support region including an angled body portion 217*a* and an upright body portion 217*b* at which an electrical outlet assembly 220 is mounted, such as shown in FIGS. 9 and 10. Flat body 216 includes a pair of parallel legs 216*a* that are joined at their respective lower ends by a perpendicular bight portion 216*b*, and that are joined at their respective upper ends by angled body portion 217*a* and/or upright body portion 217*b*. The generally L-shaped upper support region including angled body portion 217*a* and upright body portion 217*b* may be unitarily formed with parallel legs 216*a* and bight portion 216*b*, of a semi-rigid material, with parallel legs 216*a* containing armature wire or similar material so that legs 216*a* will maintain a set angle, such as shown in FIG. 9.

Instead of routing a power cord through the material of the flat body 216, a power cord 218 exits a lower region of electrical outlet assembly 220 and through an opening formed in angled body portion 217*a* near where it meets upright body portion 217*b*. Electrical outlet assembly 220 includes an outer housing 234 having a height corresponding to the height of upright body portion 217*b*, a depth corresponding to the depth of angled body portion 217*a*, rounded corners 234*a* corresponding to the shape of angled body portion 217*a*, and a top surface 234*b* having openings corresponding to a high voltage AC receptacle 224*a*, a pair of USB-style (such as USB-A) low voltage DC receptacles 224*b*, and another USB-style (such as USB-C) low voltage DC receptacle 224*c*. It will be appreciated that the angled body portion 217*a* may serve as a downwardly-facing lower surface of outer housing 234, and this body portion or lower surface is positionable to engage an upwardly-facing top surface of a cushion 12. The cushion-mountable electrical outlet assembly 210 is functionally similar to the outlet assemblies 10, 10' that are described above, such that other details of fitting, installation, and operation need not be repeated herein.

Figure 11:
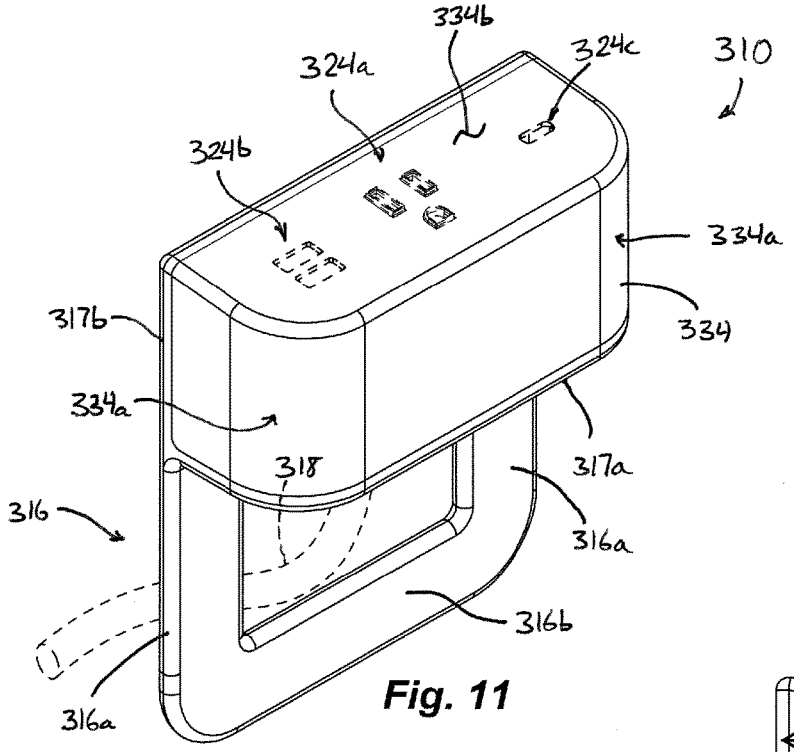
FIG. 11 is a perspective view of another cushion-mountable electrical outlet in accordance with the present invention.

In another embodiment that is similar to the cushion-mountable electrical outlet assembly 210 of FIGS. 9 and 10, another cushion-mountable electrical outlet assembly 310 (FIGS. 11 and 12) is substantially identical to assembly 210, except that assembly 310 has substantially shorter parallel legs 316*a* as compared to the parallel legs 216*a* of assembly 210. Therefore, the assembly 310 of FIGS. 11 and 12 has various components and features that are substantially similar to regions and components of assembly 210 and are given like numerals by the addition of 100, such that the components and features of assembly 310 may be readily understood with reference to the above discussion. As with the cushion-mountable electrical outlet assembly 110 of FIGS. 7 and 8, the shorter length of parallel legs 316*a* makes outlet assembly 310 more suitable for furniture applications in which most or all of the space beneath a seating cushion is inaccessible. Thus, securing of the electrical outlet assembly 310 relies substantially on pressure applied to the flat body 316 by the side edge of a cushion pressing the flat body 316 against an upright arm, such as shown in FIG. 8.

Figure 12:
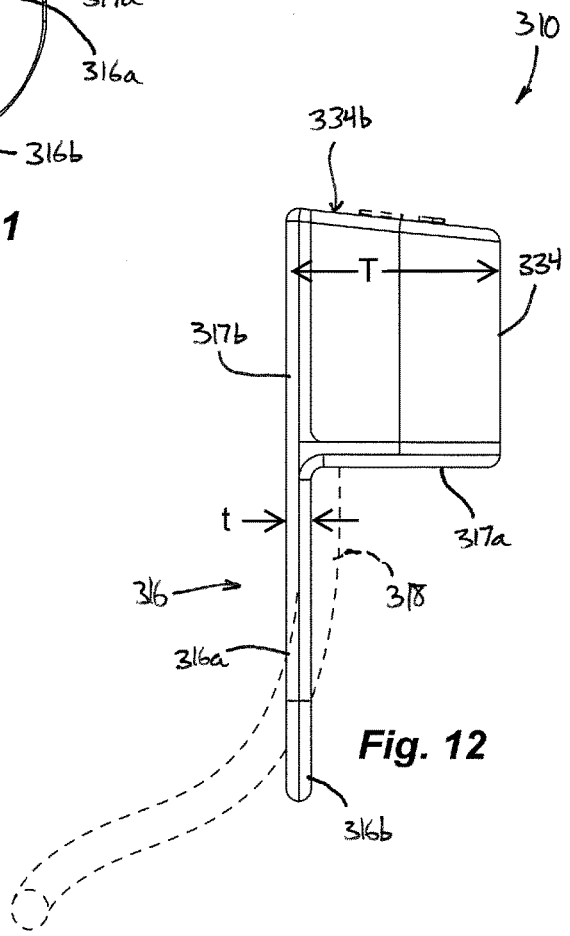
FIG. 12 is a right side elevation of the cushion-mountable electrical outlet of FIG. 11.

As best shown in FIG. 12, the top surface 334*b* of housing 334 is angled downwardly from horizontal when upright body portion 317*b* is vertically oriented, which may promote runoff of liquids in case of an inadvertent spill. This may reduce the likelihood of an electrical short or the blocking or coating of electrical terminals with contaminants that could affect the proper functioning of the electrical outlets 324*a-c*. It will also be appreciated that most of the outlet housing 334 may be integrally formed with either or both of the angled body portion 317*a* and upright body portion 317*b*.

Figure 4:
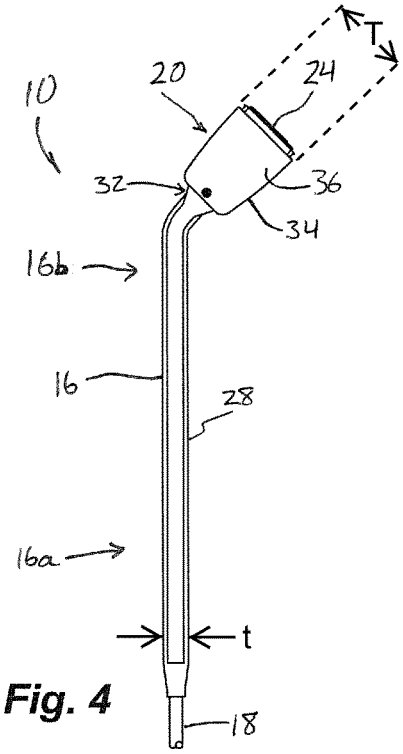
FIG. 4 is a right side elevation of the cushion-mountable electrical outlet, shown prior to a bending operation for fitting the cushion-mountable electrical outlet to a cushion having a known thickness.
Figure 5:
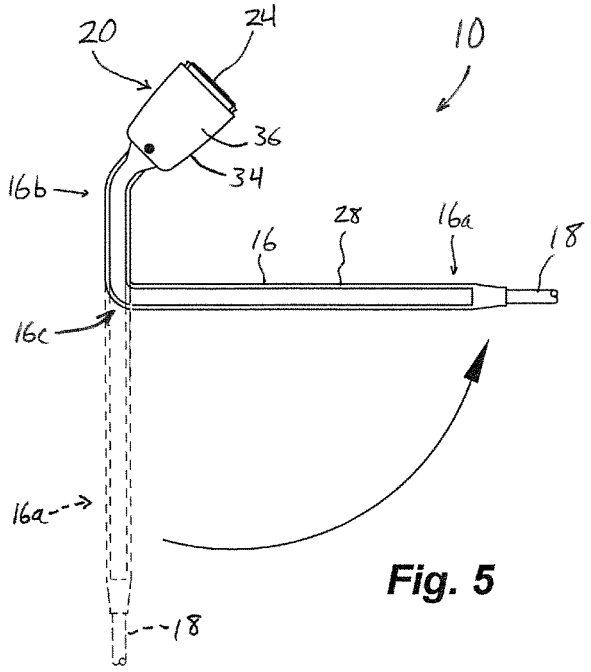
FIG. 5 is a right side elevation of the cushion-mountable electrical outlet, depicting a bending operation for fitting the cushion-mounted electrical outlet to a cushion.

Referring to FIGS. 4, 8 and 12, it will be observed that each electrical outlet housing 34, 134, 234 has a respective overall thickness T, while its corresponding flat body 16, 116, 216 has a thickness t that is substantially less than thickness T of the outlet housing. For example, in FIG. 4 the thickness T of outlet housing 34 is approximately two to three times the thickness t of the flat body 16. In FIG. 8 the thickness T of outlet housing 134 is also approximately three times the thickness t of the flat body 116 including the wiring passageway 128, or approximately five times the thickness of just the flat body 116 outboard of the wiring passageway 128. In FIG. 12 the thickness T of the outlet housing 234 is approximately six to eight times the thickness t of the flat body 316

Thus, the cushion-mountable electrical outlet assemblies of the present invention provide convenient access to electrical power and/or electronic data connections at or along a furniture article having a removable at least partially-separable cushion. Because the cushion-mountable electrical outlet assemblies are typically held in place at the furniture articles only by gravity and friction, and not with mechanical fasteners, the outlet assemblies are readily removable and replaceable as desired, and may also be reconfigured for use at different furniture articles including articles having different thicknesses of cushions or the like.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. A cushion-mountable electrical outlet system for furniture, said electrical outlet system comprising:

a generally flat body having a proximal end portion configured to be positioned between a cushion and a panel of a furniture article that is proximate the cushion, said flat body having an upright distal end portion configured to be positioned alongside an upright side edge of the cushion, and said flat body having a deformable region below said upright distal end portion;

an electrical outlet assembly mounted at said distal end portion of said flat body and positionable so as to be accessible to a user supported at the cushion;

an electrical outlet mounted at said electrical outlet assembly and facing generally upwardly; and an electrical cord in electrical communication with said electrical outlet and exiting said electrical outlet assembly.

2. The electrical outlet system of claim 1, wherein said generally flat body comprises a resinous material disposed around a plastically deformable metal in said deformable region.

3. The electrical outlet system of claim 1, wherein said generally flat body is plastically deformable at different locations along a continuum of said deformable region.

4. The electrical outlet system of claim 1, wherein said electrical outlet assembly is positionable at different angles relative to said upright distal end portion of said flat body.

5. The electrical outlet system of claim 1, wherein said flat body defines a passageway extending from said proximal end portion to said distal end portion through which said electrical cord is routed, wherein said electrical cord extends the entire length of said flat body.

6. The electrical outlet system of claim 5, wherein said passageway of said flat body is located along a central longitudinal axis of said flat body.

7. The electrical outlet system of claim 1, wherein said electrical outlet assembly comprises at least one chosen from a high voltage AC power outlet, a low voltage DC power outlet, and an electronic data outlet.

8. The electrical outlet system of claim 7, wherein said electrical outlet assembly comprises a substantially planar top surface having one or more openings corresponding to said at least one chosen from a high voltage AC power outlet, a low voltage DC power outlet, and an electronic data outlet, wherein said top surface is non-perpendicular to said upright distal end portion of said flat body, and wherein said top surface is angled relative to a horizontal plane when said upright distal end portion of said flat body is oriented in a vertical plane.

9. The electrical outlet system of claim 1, wherein said generally flat body comprises a pair of parallel spaced-apart legs that are joined at their respective proximal ends by a bight portion opposite said electrical outlet assembly.

10. The electrical outlet system of claim 9, wherein each of said legs comprises a resinous material disposed around a plastically deformable metal in said deformable region.

11. The electrical outlet system of claim 9, wherein said electrical cord exits a lower region of said electrical outlet assembly and is spaced between said legs.

12. A cushion-mountable electrical outlet system for furniture, said electrical outlet system comprising:

a generally flat body having an upper end portion, a plastically deformable region, and a lower end portion, wherein said deformable region is configured to be deformed to set said lower end portion at an oblique angle relative to said upper end portion, wherein the lower end portion is configured to be positioned between a downwardly-facing surface of a cushion and an upwardly-facing surface of a furniture article that supports the cushion, and the upper end portion is configured to be positioned alongside an upright side edge of the cushion;

an electrical outlet assembly coupled to said upper end portion of said flat body and positionable so as to be accessible to a user supported at the cushion, wherein the electrical outlet assembly comprises a downwardly-facing lower surface configured to engage an upwardly-facing top surface of the cushion;

an electrical receptacle mounted at said electrical outlet assembly above said downwardly-facing lower surface.

13. The electrical outlet system of claim 12, wherein said upper and lower end portions each comprise a respective portion of said plastically deformable region.

14. The electrical outlet system of claim 12, wherein said electrical outlet assembly comprises at least one chosen from a high voltage AC power outlet, a low voltage DC power outlet, and an electronic data outlet.

15. The electrical outlet system of claim 14, wherein said electrical outlet assembly comprises a substantially planar top surface having one or more openings corresponding to said at least one chosen from a high voltage AC power outlet, a low voltage DC power outlet, and an electronic data outlet, wherein said top surface is non-perpendicular to said upper end portion, and wherein said top surface is angled relative to a horizontal plane when said upright distal end portion of said flat body is oriented in a vertical plane.

16. The electrical outlet system of claim 12, wherein said generally flat body is plastically deformable at different locations along a continuum of said deformable region.

17. The electrical outlet system of claim 16, wherein said generally flat body comprises a resinous material disposed around a plastically deformable metal in said deformable region.

18. The electrical outlet system of claim 16, wherein said generally flat body comprises a pair of parallel spaced-apart legs that are joined at their respective proximal ends by a bight portion opposite said electrical outlet assembly.

19. The electrical outlet system of claim 18, wherein each of said legs comprises a resinous material disposed around a plastically deformable metal in said deformable region.

20. The electrical outlet system of claim 18, further comprising an electrical cord in electrical communication with an electrical outlet of said electrical outlet assembly, wherein said electrical cord exits a lower region of said electrical outlet assembly at a location that is spaced between said legs.

* * * * *